US006158787A

United States Patent [19]

Kutschat

[11] Patent Number: 6,158,787

[45] Date of Patent: Dec. 12, 2000

[54] VEHICLE DOOR LOCK WITH U-SHAPED OPERATING LEVER

[75] Inventor: Horst Kutschat, Wuppertal, Germany

[73] Assignee: D. La Porte Sohne GmbH, Wuppertal, Germany

[21] Appl. No.: 08/991,692

[22] Filed: Dec. 16, 1997

[30] Foreign Application Priority Data

Dec. 19, 1996 [DE] Germany ..... 196 53 169

[51] Int. Cl.[7] ..... E05C 3/06

[52] U.S. Cl. ..... 292/214; 292/56

[58] Field of Search ..... 292/11, 26, 214, 292/216, 336.3, DIG. 23, 24, 56

[56] References Cited

U.S. PATENT DOCUMENTS

| | | | |
|---|---|---|---|
| 2,582,926 | 1/1952 | Dall | 292/216 |
| 2,807,492 | 9/1957 | Jakeway | 292/336.3 |
| 2,955,859 | 10/1960 | Krause | 292/6 |
| 3,112,946 | 12/1963 | Wernig | 292/223 |
| 3,140,888 | 7/1964 | Salvo | 292/48 |
| 3,231,302 | 1/1966 | Westerdale | 292/52 |
| 3,666,305 | 5/1972 | Schlichter | 292/48 |
| 4,763,934 | 8/1988 | Kaveney, Jr. | 292/21 |
| 4,913,477 | 4/1990 | Watanuki et al. | 292/216 |

FOREIGN PATENT DOCUMENTS

| | | | |
|---|---|---|---|
| 0398047 | 11/1990 | European Pat. Off. | E05B 65/19 |
| 1953184 | 7/1970 | Germany | E05B 65/32 |
| 7147548 | 5/1972 | Germany | E05B 65/32 |
| 2149839 | 6/1972 | Germany | E05B 65/32 |
| 2259603 | 6/1974 | Germany | E05B 65/24 |
| 3010388 | 10/1980 | Germany | E05B 65/30 |
| 8714311 | 1/1988 | Germany | E05B 65/35 |
| 3923726 | 1/1991 | Germany | E05B 65/20 |
| 4119703 | 10/1992 | Germany | E05B 65/32 |
| 4226127 | 12/1993 | Germany | E05B 65/12 |
| 4311786 | 10/1994 | Germany | E05B 65/12 |
| 2034395 | 6/1980 | United Kingdom | E05C 3/24 |
| 2045336 | 10/1980 | United Kingdom | E05C 3/22 |
| 2073299 | 10/1981 | United Kingdom | E05B 65/12 |
| 2108191 | 5/1983 | United Kingdom | E05B 65/32 |

*Primary Examiner*—B. Dayoan
*Assistant Examiner*—Gary Estremsky
*Attorney, Agent, or Firm*—Goodman & Teitelbaum, Esqs.

[57] ABSTRACT

A rotary latch lock for the locking closure of a door, especially of a vehicle door of a tractor, including a rotary latch, a rotary latch spring coacting with the rotary latch as well as a stop piece, the rotary latch and the stop piece being pivotally mounted and capable of coacting in the bolting of the lock. The bolting is released by a lever system which has an actuating lever for acting on the stop piece. The rotary latch lock is provided with a lock base plate, the lock base plate being bent in a U-shaped configuration to include first and second shanks and a base shank, so that the actuating lever is articulated on the second shank, and the stop lever is articulated on the first shank, where the first shank provides a wall of the lock box.

49 Claims, 14 Drawing Sheets

VEHICLE DOOR LOCK WITH U-SHAPED OPERATING LEVER

Figure 1:
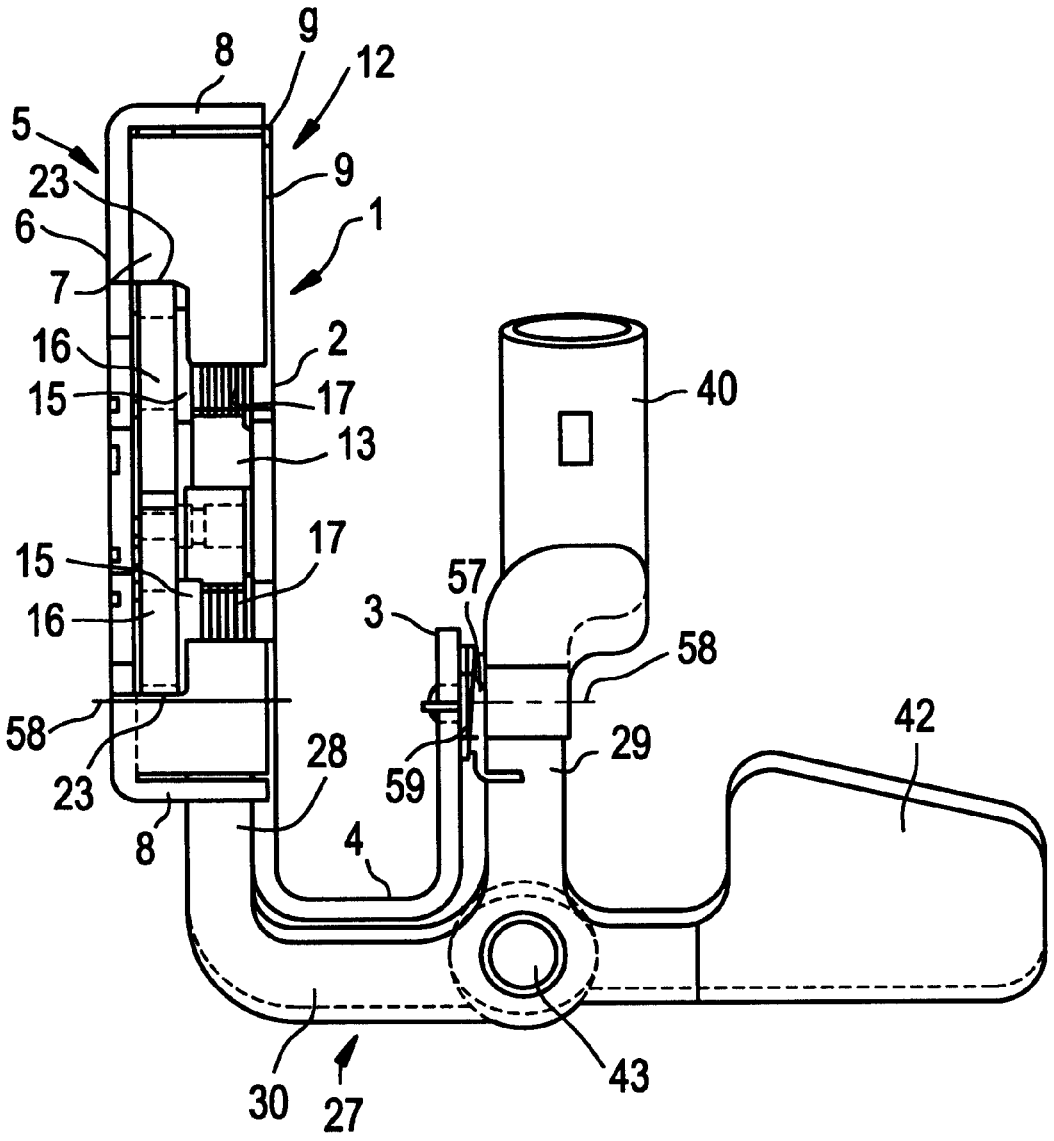

The invention relates to a vehicle door lock.

Such vehicle door locks serve for the bolting and closing of vehicle doors, especially of doors of agricultural machines, such as, for example, tractors.

Such door locks as they are known from the state of the art (FIG. 15), have, for example, a flat slab-form lock box 100, which is mounted on the vehicle door.

The lock box 100 comprises the components necessary for the bolting closing and has, in the direction to a closing bolt projecting horizontally on the door post, a recess 102 in which in the closed state of the door the closing bolt is received.

Adjacent to the recess 102 and underneath this the lock box 100 has in each case a rotary latch 104 swingable about a turning pin 103.

The rotary latches 104 are plate-form elements which have catching lugs 105 projecting outward in the direction to the horizontal closing bolts over the lock box 100.

The catching lugs 105 have in each case a chamfering 106 in the surrounding edge 107 of the rotary latch 104. The chamferings 106 of the lugs 105 face one another. With the zones of the surrounding edge 107 facing away from the chamferings 106 of the lugs 105, the lugs 105 lie on the narrow-side wall 108 of the lock box 101 under pressure of a lock box spring 109 acting on the rotary latches 104.

Into the surrounding edges 107 of the rotary latches 104 there are introduced in each case two adjacent rectangular recesses 110, in which arrangement the recesses 110 of the two rotary latches 104 lie opposite one another in open lock position.

In the zone lying opposite the recess 102 of the rotary latch 104, between rotary latches 104 and the narrow side wall 111 lying opposite the narrow side wall 108, there is arranged a stop lever 112. The stop lever 112 is swingable about a pivot 113, the pivot 113 being horizontally arranged in a corner zone of the lock box 100.

On the stop lever 112 there is molded, facing the rotary latches 104, a rectangular stop piece 114. With a corner 114*a,* 114*b* each the stop piece 114 bears on the rotary latches 104 under pressure of a stop lever spring 115.

When a vehicle door is closed, the closing bolt arranged on the door post passes into the zone of the chamferings 106 of the rotary latches 104. By the pressure of the bolt on the rotary latches 104 these are swung against the pressure of the rotary latch springs 109 about the pivots 103. By the rotary movement the lugs 105 pass behind the bolt and grip this latter. In the closed position the bolt finds itself between the two rotary latches 104 in the zone of the chamferings 106. By the swinging of the rotary latches 104 the rectangular stop recesses 110 come into the zone of the stop piece 114 which grips into the first recesses 110, when the distance between the top recesses 110 of each rotary latch 104 is sufficient, under spring pressure (safety stop-lock is not completely closed). In further swinging of the rotary latches 104 the stop piece 114 with a corner 114*a,* 114*b* each engages into a second stop recess 110 in the rotary latches 104.

The rotary latches 104 are supported now with the flanks of the recesses 110 on a flank each of the corners 114*a,* 114*b* of the stop piece 114, and are thus held against the pressure of the rotary latch spring 109 in closed position.

If the vehicle door lock and therewith the door is to be opened, a lever system (not shown) which is located in the door is activated. This lever system acts on the stop lever 112, which is now moved out of the stop recesses 110 against the pressure of the stop lever spring 115.

When the stop piece 114 or the corners 114*a,* 114*b* of the stop piece 114 have left the recesses 110, the rotary latches 104, under the pressure of the rotary latch spring 109, snap back into their starting position, therefore the open lock position. The closing bolt is moved by the flanks of the chamferings 106 out of the lock box 100.

With this vehicle door lock it is disadvantageous that the lever system present in the door must be adjusted by means of adjusting screws attuned to one another. Moreover, after a number of actuations of the lock a readjustment must take place. Further, a complex lever system according to the state of the art is associated with a considerable assembling expenditure.

Moreover, such vehicle door locks according to the state of the art offer no possibility whatsoever of preventing an inadvertent opening of the vehicle door lock from the interior of the vehicle.

The problem of the invention is to create a vehicle door lock which can be economically manufactured.

The problem is solved with a vehicle door lock having the features set forth below. Advantageous developments are also characterized below.

In the following the invention is explained by way of example, with the figures showing here the following several features.

Figure 8A:
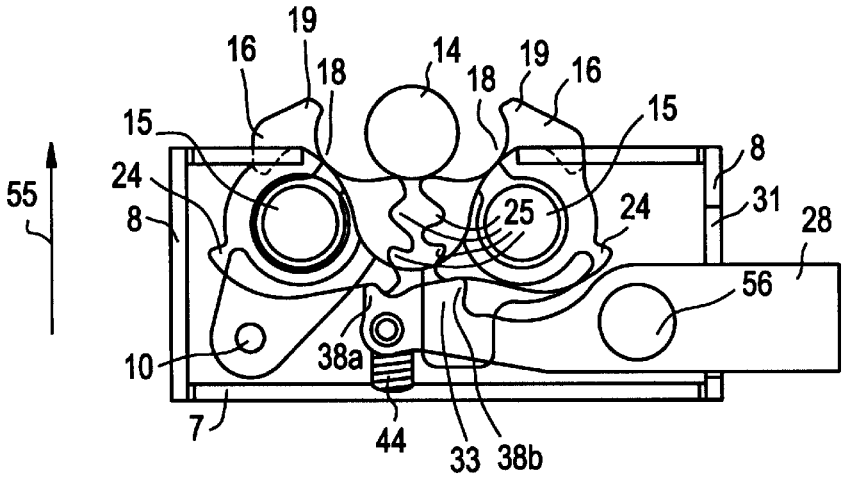
Figure 8B:
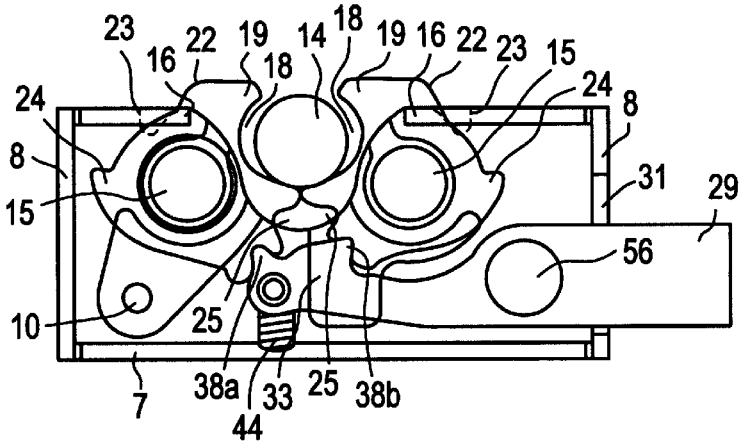
Figure 8C:
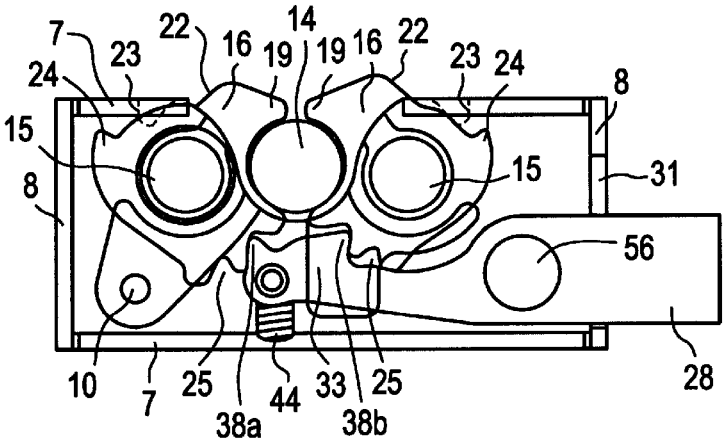
Figure 9A:
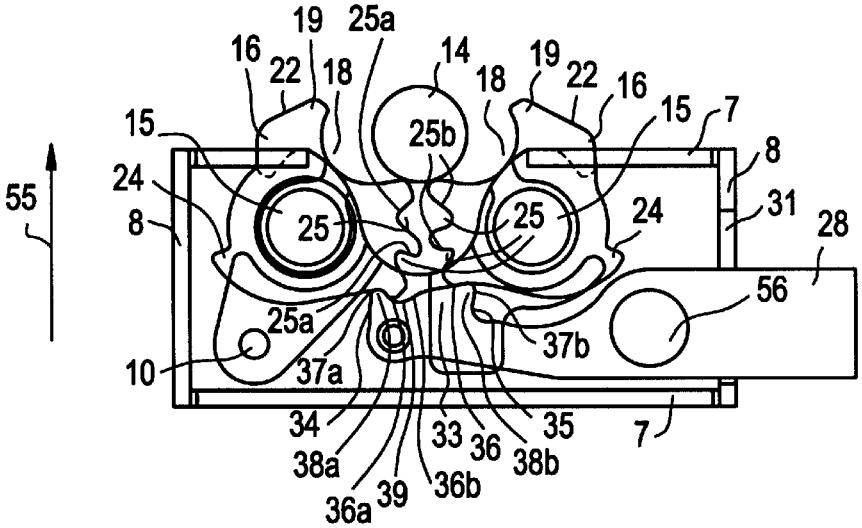
Figure 10:
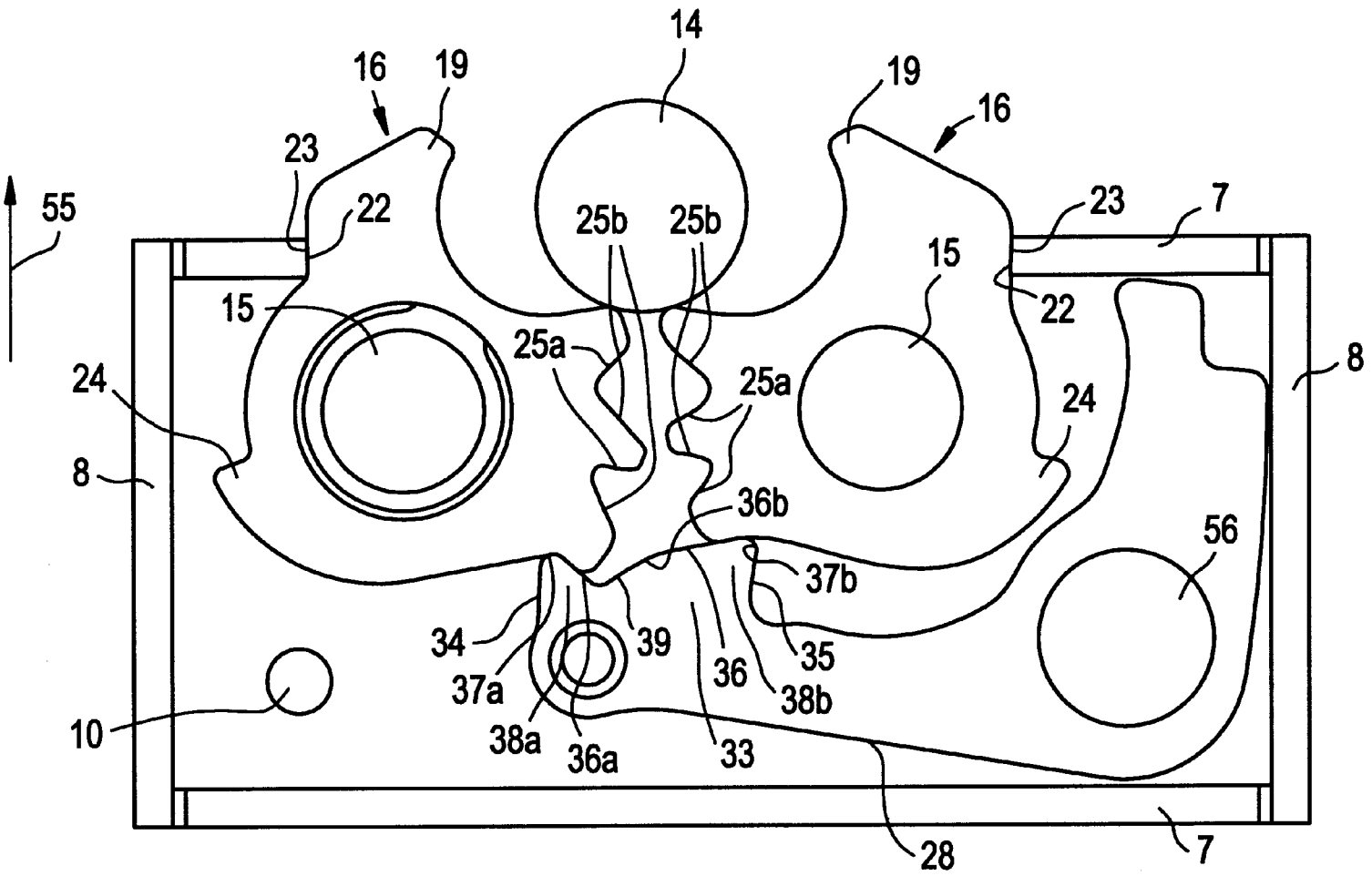
Figure 12:
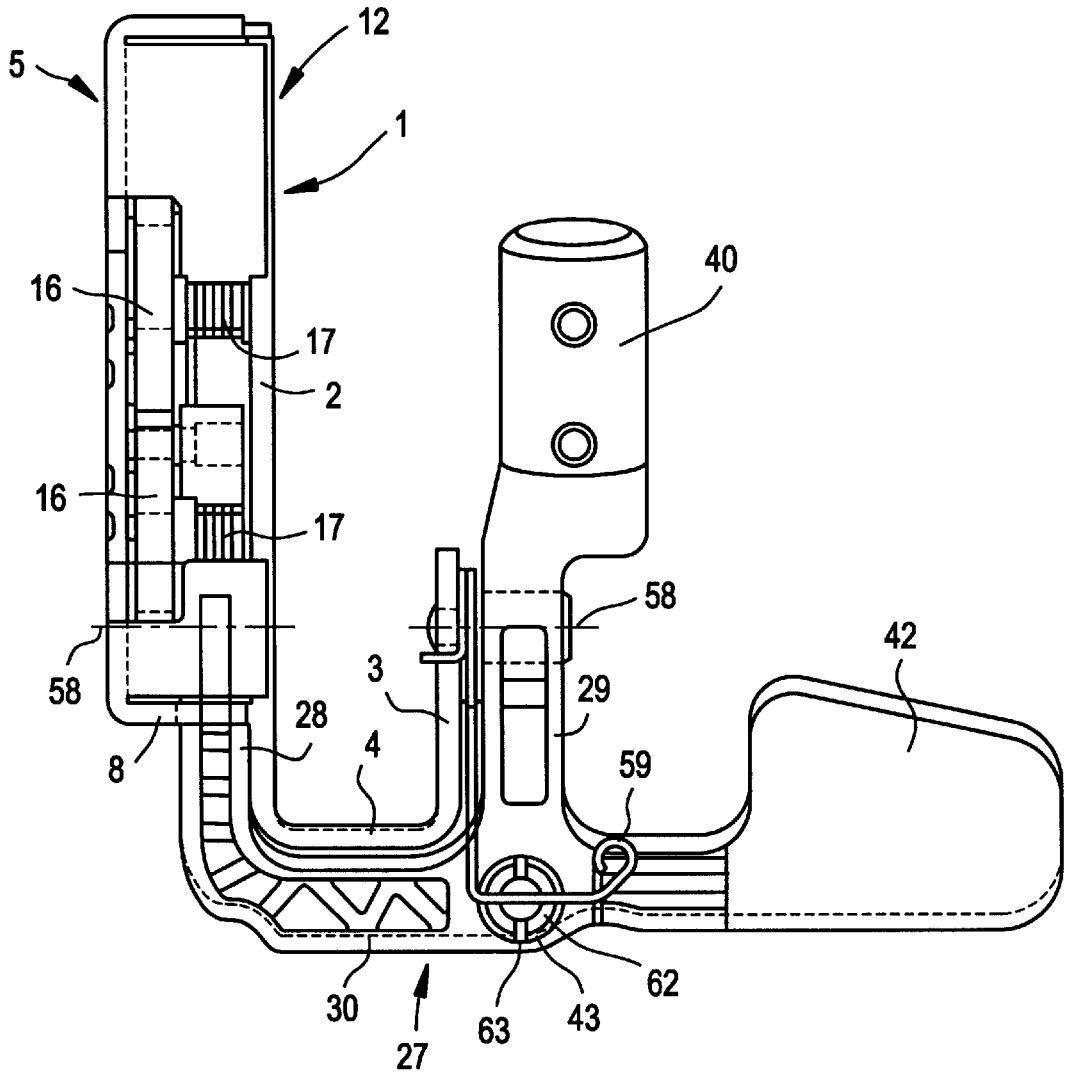
Figure 13:
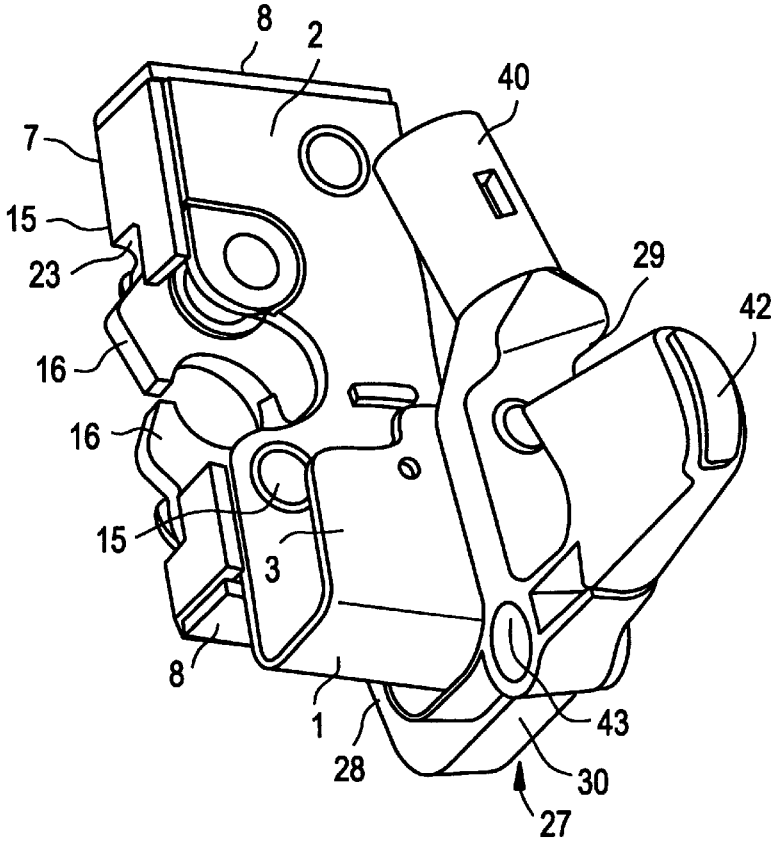

FIG. 1 A vehicle door lock according to the invention as viewed from the inside of the door, FIG. 2 A vehicle door lock according to the invention according to FIG. 1 in a lever-side view, FIG. 3 A vehicle door lock according to FIG. 1 from below, FIG. 4 A vehicle door lock according to the invention with child safety feature, seen from the inside of the door, FIG. 5 A vehicle door lock according to FIG. 4 in a lever-side side view, FIG. 6 A vehicle door lock according to FIG. 4 from underneath, FIGS. 7*a, b, c* A form of execution of a vehicle door lock in a sectioned view in open-, half-closed-, and closed position, FIGS. 8*a, b, c* A section through a lock box of a door lock of the invention according to FIG. 3, in open-, half-closed-, and closed position, FIGS. 9*a, b, c* A section through a lock box of a form of execution of a vehicle door lock according to the invention in open-, half-closed-, and closed position, FIG. 10 A section through a lock box of a vehicle door lock according to the invention in open position, FIG. 11 A further form of execution of a vehicle door lock according to the invention, in a lever-side side view, FIG. 12 A form of execution of a vehicle door lock according to FIG. 11, as seen from the inside of the door, FIG. 13 A representation, in perspective, of a vehicle door lock according to the invention, from the side.

Figure 14:
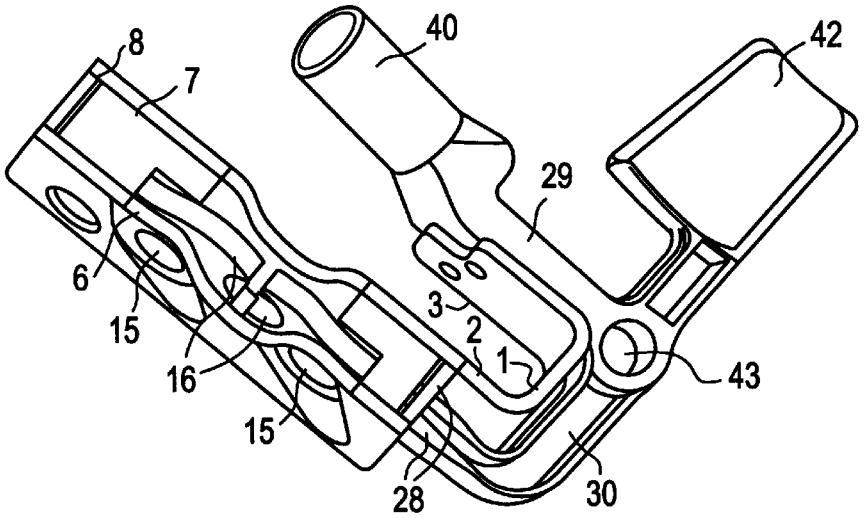
Figure 15:
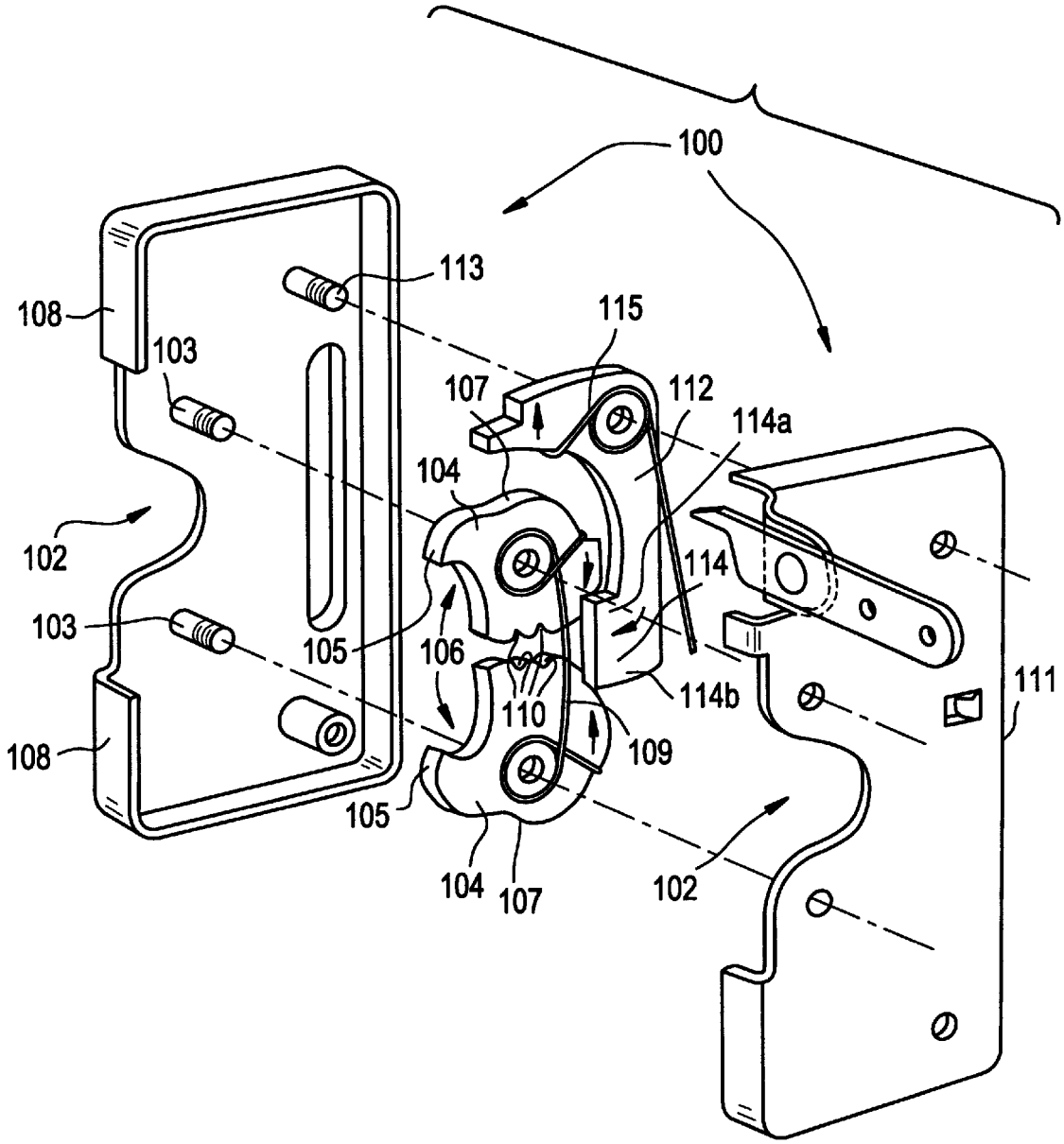
FIG. 15 PRIOR ART

FIG. 14 A plan view, in perspective, of a vehicle door lock according to the invention as seen from the inside of the door, FIG. 15 A vehicle door lock according to the state of the art in a perspective exploded view.

A door lock according to the invention has a flat lock base plate 1, which is bent in U-form and, therefore, presents two free U-shanks 2, 3 and a base shank 4 (FIG. 1).

The two U-shanks 2, 3 can be of different length and in FIG. 1 they are vertically oriented; the base shank 4 is horizontally oriented. On the outer flat sides of the long U-shank 2 there is arranged a lock box plate 5.

The lock box plate 5 has a rectangular base wall 6 which, with respect to its lengthwise extent, is arranged parallel to the U-shank 2 and its width corresponds about to the width of the U-shank 2 and to the orientation of the latter. On the side edges of the base wall 6, for the formation of a slab-form lock box 12 there are joined two longitudinal side walls 7 and two face side walls 8.

The longitudinal side walls 7 and the upper face side wall 8 lie on the face edges 9 of the free U-shank 2; the lower face side wall 8 rests with its face edge on the U-shank 2.

In the lock box 12 about in the longitudinal middle of a longitudinal side wall 7 there is arranged an approximately semicircular or elliptical recess 13 which provides space for the reception of a door closing bolt 14. The recess 13 extends therefore from the longitudinal side wall 7 approximately to the transverse middle of the lock base plate 1 and of the lock box plate 5.

Above and below the recess 13 about in the half of the horizontal extent of the recess 13 there are arranged in each case a hollow cylindrical axial bolt 15 between the lock base plate 1 and the lock box plate 5, which grip through the lock base plate 1 and the lock box plate 5 and preferably fasten these to one another.

Through the hollow cylindrical axial bolts 15 there can be driven screws with which the lock can be screwed to a door or to a door frame.

On each of the horizontal axial bolts 15, adjacent to the base wall 6 of the lock box plate 5 there is pivotally mounted a rotary latch 16, aligned with one another and slightly spaced from one another. Between the rotary latches 16 and the lock base plate 1 there is arranged in each case a rotary latch spring 17.

Figure 2:
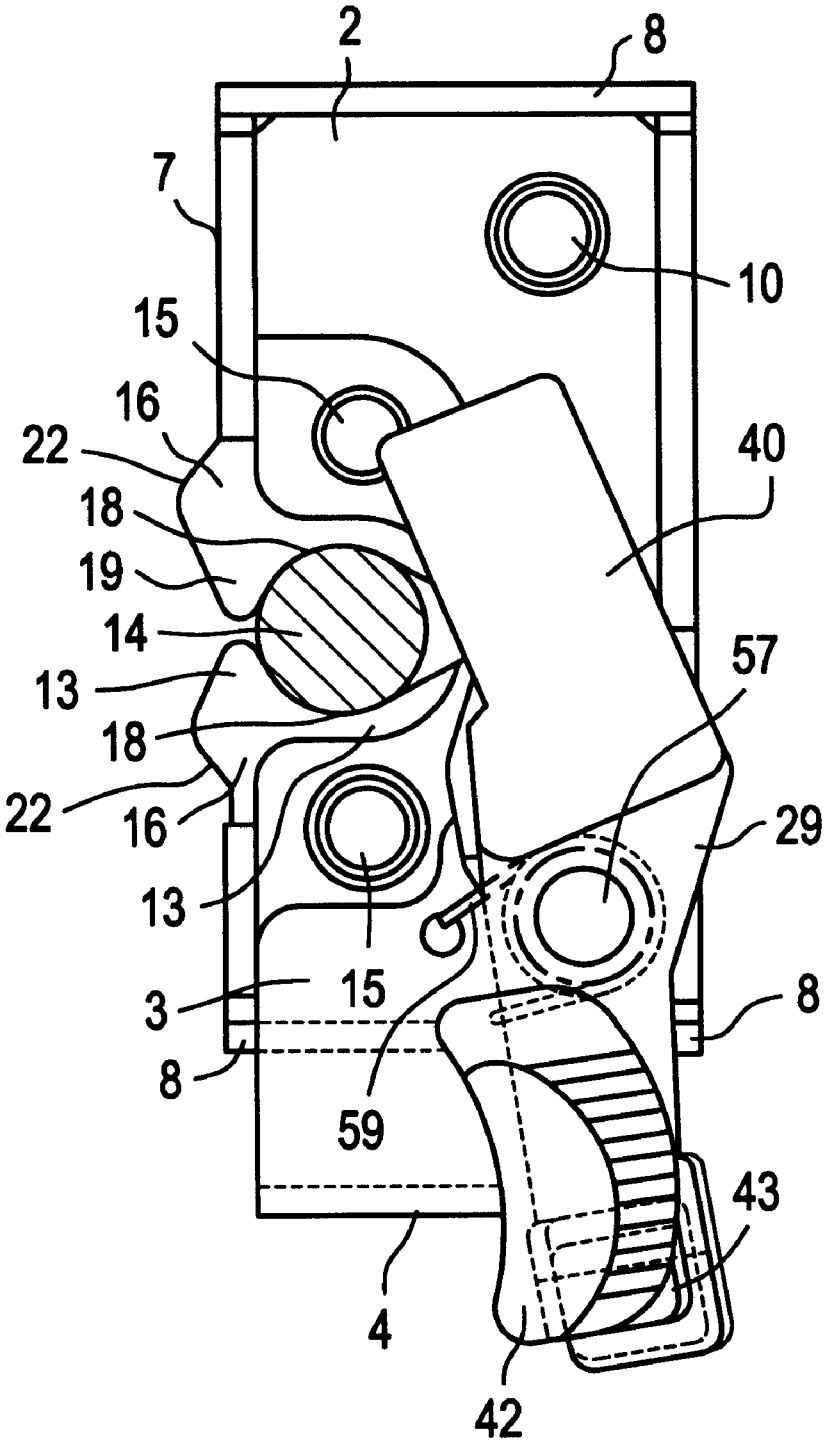

The rotary latches 16 are plate-form elements, for example plates of steel (FIG. 2). On each rotary latch 16 there are formed in each case a bolt lug 19 with a chamfering 18. In the open lock position the lugs 19 stand over the longitudinal side wall 7, in which the recess 13 is arranged laterally beyond the side wall 7. The chamferings 18 of the locking lugs 9 in the latches 16 are arranged facing one another.

On the surrounding edge surfaces of rotary latches 16 lying opposite the chamferings 18, there are arranged contact edges 22.

The rotary latch springs 17 (FIG. 1) act in a manner similar to that known from the state of the art, with in each case a spring shank on a projection 24 (FIGS. 7*a* to 9*c*) which is molded approximately diametrically to the chamferings 18 on the rotary latches 16. With the other spring shank they are preferably supported on one of the vertical side walls 7; the rotary latch springs 17 can, however, also be joined with these shanks. The rotary latch springs 17 have the tendency to hold the rotary latches 16 in open position (FIG. 7*a,* FIG. 8*a,* FIG. 9*a*) and to press apart the facing bolt lugs 19.

Adjacent to each of the chamferings 18 on the side opposite the lug 19 of the chamferings 18 there are arranged in each case two adjacent stop recesses in the surrounding edge of the rotary latches 16.

Figure 7A:
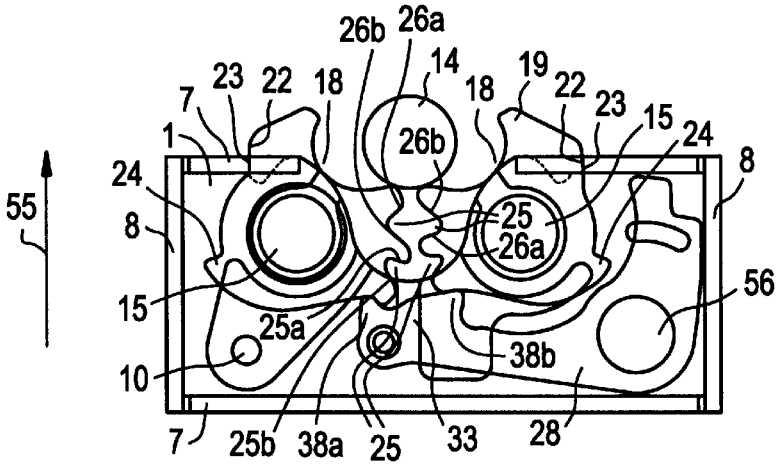
Figure 7B:
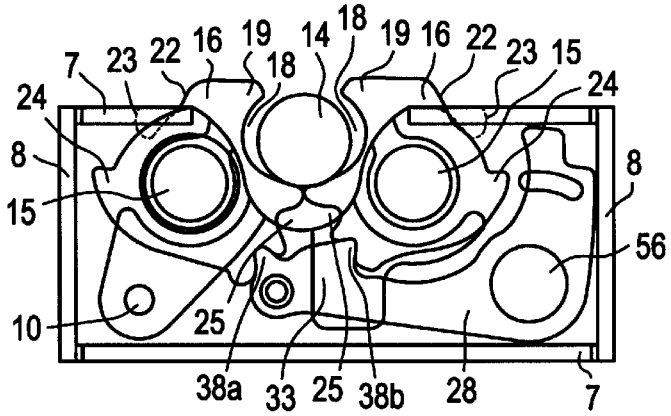
Figure 7C:
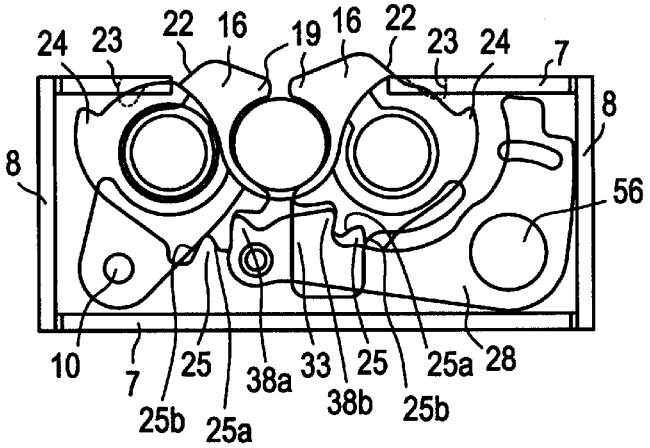

The stop recesses 25 are approximately V-shaped, but undercut, so that each stop recess has a short, undercut flank 25*a* and a long flank 25*b* (FIG. 7*a*). The bottoms of the stop recesses 25 are rounded.

On and about the U-shaped lock base plate 1 there is arranged a substantially U-shaped unbolting lever 27 (FIG. 1). The unbolting lever 27 has two free U-shanks 28, 29 as well as a U-base strip 30 connecting these.

The base strip 30 is arranged essentially parallel to the U-base strip 4 of the lock base plate 1. Essentially parallel to the free U-shank 2 of the lock base plate 1, the shank 28 or lock arm 28 of the lever 27 extends, in the direction of the lock box 12 and through the recess 31 (FIG. 3) in the face side wall 8 facing the base shank 4, into the lock box 12.

The free end of the shank or rest arm 28 extends up to the height of the two rotary latches 16 (FIGS. 8*a* to 9*c*).

In the direction to the rotary latches 16, a rest piece 33 is laterally molded onto the end of the shank 28.

The stop piece 33 has two face edges 34, 35 and on rotary latch side a longitudinal edge 36 connecting the face edges 34, 35 (FIG. 9).

The longitudinal edge 36 of the stop piece 33 and the face edges 34, 35 have common corners 37*a,* 37*b*.

Into the longitudinal edge 36 there is introduced a chamfering 39 which is shifted in the direction of the free end of the shank 28, so that the edge pieces 36*a,* 36*b* are of different length from the bottom of the chamfering 39 to the corners 37. Hereby there is formed in each case a stop lug 38*a,* 38*b* (FIG. 9).

The corners 37*a,* 37*b* are rounded, the edges 34 and 36*b* as well as 35 and 36*b* enclosing in each case an acute angle.

The edge 36*b* runs, moreover, not in a straight line from the bottom of the chamfering 39 to the corner 37*b,* but is slightly curved, in such manner that from the bottom of the chamfering 39 it has at first a steeper course and then becomes flatter and flatter toward the corner 37*b*.

The edge 35 is slightly undercut from the corner 37*b* to the shank 28, so that the stop piece 33 for the corners 37*a,* 37*b* is somewhat wider in the zone of the edge 35 (FIG. 9).

In safety stop position of the lock, i.e. when the stop lugs 38*a,* 38*b* are located in the first stop recesses 25 of the rotary latches 16, the corners 37*a,* 37*b* of the stop lugs 38*a,* 38*b* are gripped in closed form by the stop recesses 25. I.e, the short flanks 25*a* of the stop recesses 25 rest on the edges 36*a*, 36*b,* and the long flanks 25*b* rest against the face edges 34, 35.

In complete closing position, i.e. when the stop lugs 38*a,* 38*b* are located in the second stop recesses 25, in each case in turning direction, the stop recesses 25 lie only on the edges 34, 35, such that one stop recess 25 lies with its edge 25*b* on the face edge 34, and the other stop recess 25 lies with its edge 25*a* on the face edge 35.

The face edge 35 with widening stop piece 33 acts advantageously with undercutting effect in the correspondingly formed or undercut stop recesses 25 such that when the face edge 35 is to be led out of the stop recess 25, there must also be overcome the resistance of the rotary latch spring 17 which is stretched in the process.

Between stop piece 33 and the face wall 8 facing the U-base strips 4, 30 of the lock box 12, the lever 27 or its shank 28 is swingably borne on a preferably hollow cylindrical pivot 56 gripping through and connecting the lock base plate 1 with the lock box plate 5.

In alignment in height and side to this pivot 56, on the outside of the U-shank 3 of the lock base plate 1, there is arranged a second pivot 57 (FIGS. 2, 3), on which the lever 27, with its U-shank or actuating arm or actuating lever 29, is likewise swingably borne, the pivot axis 58 of the two pivots pins 56, 57 being alike.

Figure 11:
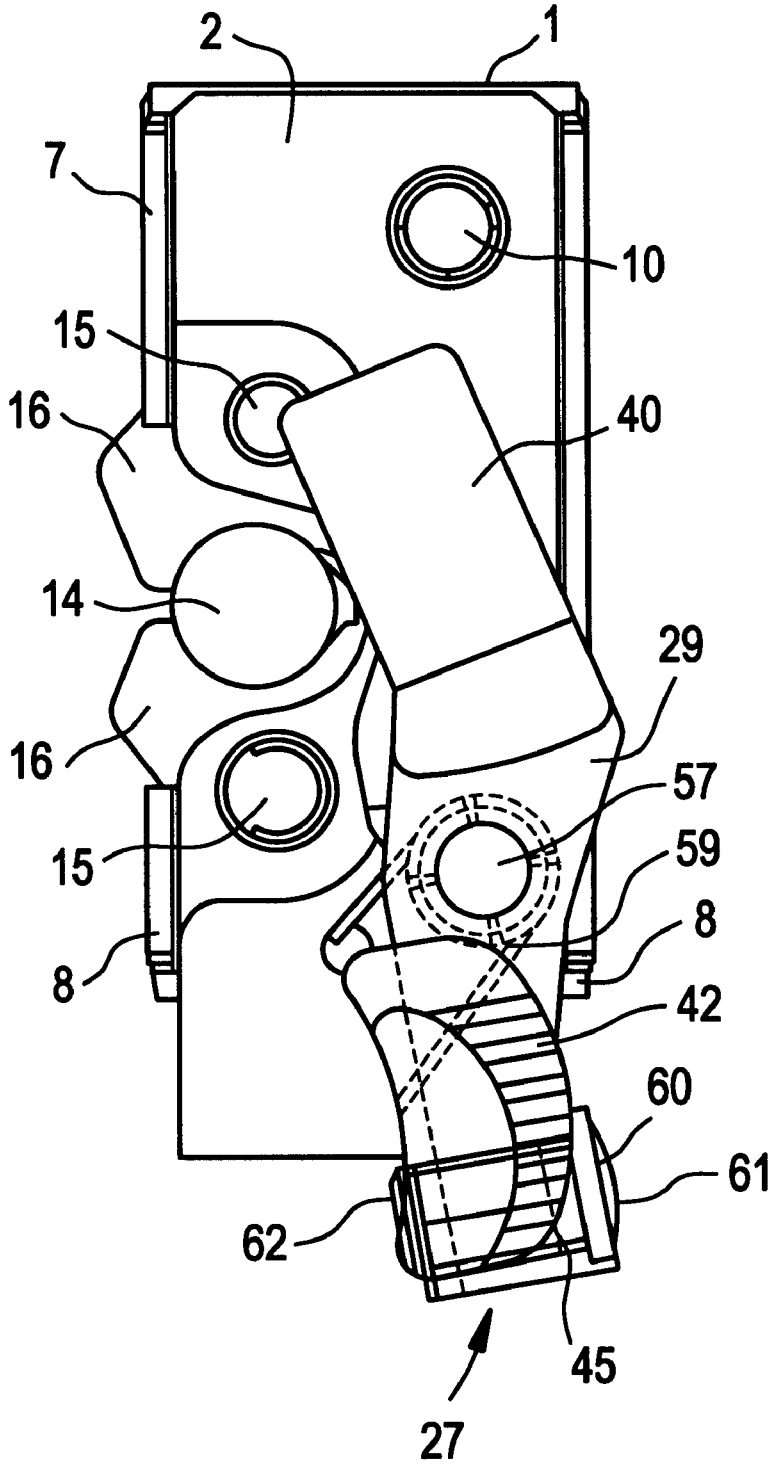

About the rotary pivot 57 there can be arranged a spring 59 which acts on the lever 27 in such manner that the stop piece 33 is pressed onto the rotary latches 16 and contacts these (FIG. 11).

The U-shank 29 extends beyond the pivot pin 57. Its free end is constructed as a balancing weight 40 (FIG. 1).

The U-base shank 30 is extended beyond the U-shank 29 and constructed as opening grip 42. With the opening grip 42 the lock can be actuated from the interior of the vehicle over the shank 29. The shank 29 takes over the function of an actuating lever. The crossing zone between shank 29, base strip 30 and lever 42 presents a bore 43 perpendicular to the extension direction of the shank 24 and of the lever 42.

The bore 43 serves for the reception of a setting screw 45 (FIGS. 11, 12) with which the play between lever 27 and an actuating element which can be acted upon from the outside of the door is adjustable.

The setting screw 45 is screwed into the bore 42, from the side lying opposite to the rotary latches.

On one side toward the actuating element the setting screw 45 overhangs with a flat rounded head 60. On the smooth rounded surface 61 of the head 60 there lies the actuating element (not shown), for example a door opening depressor, preferably without play. The play is adjusted by the screw-in depth of the screw 45.

On the smooth surface 61 of the head 60 the actuating element can slide in the actuation. On the side 62 lying opposite the head 60, the setting screw 45 has a cross-slit 63 (FIG. 12).

The spring 59 which acts on the lever 27 is lengthened, when screw 45 is present, in the direction of the crossing zone between shank 29, base strip 30 and lever 42. At the level of the bore 43 the spring 59 is bent over about 90° and extends in the direction to the opening lever 42 beyond the bore 43.

The spring shank of the spring 59 rests in one of the two slots oriented at a right angle to one another, forming the cross slot 63, and thus it prevents a turning of the screw 45, whereby the play between screw head 60 and actuating element does not change or is not set by inadvertent turning of the screw.

If the screw 45 is to be turned, then first the spring 59 must be lifted out of the cross slot 63.

Between the longitudinal side wall 7 facing away from the stop piece 33 and the free end of the U-shank 28, there can be arranged a spring 44 (FIGS. 8*a*, 8*b*, 8*c*) which presses the stop piece 33 against the rotary latches 16 or, with lock open, into the stop recesses 25.

In open position of the lock the stop recesses 25 are located between the bolt lugs 19 of the rotary latches 16 and the stop piece 33, in which the stop recesses 25 of the rotary latches 16 lie opposite. When the door is closed, then the door closing bolt 14 presses against the rotary latches 16 against the pressure of the rotary drop springs 17. Hereby the rotary latches 16 turn oppositely about the hollow cylindrical axial bolts 15, so that the bolting lugs 19 move toward one another and, as seen in door closing direction (arrow 55), pass behind the door-closing bolt.

Through the rotary movement the first stop recesses 25 pass into the region of the stop piece 33 standing under spring pressure, the stop lugs 38*a*, 38*b* of which pass into the first stop recess 25 as soon as the distance between the respective stop recesses 25 of the two rotary latches 16 is great enough (safety stop). If the rotary latches 16 are turned further, the stop lugs 38*a*, 38*b* pass into the in each case second stop recesses 25 of the rotary latches 16. The rotary latches 16 are then in complete closing position (FIGS. 7*c*, 8*c*, 9*c*), in which the door closing bolt 14 is firmly gripped by the rotary latches 16.

The lock is hereby held in closed position.

When the opening grip 42 is actuated, then the stop piece 33 is pressed against the pressure of the spring 59 or 44 out of the stop recesses 25 and the projecting stop lugs 38*a*, 38*b*, are pressed against the pressure of the rotary latch springs 17 out of the stop recesses 25. When the stop piece 33 with its stop lugs 38*a*, 38*b* has moved entirely out of the stop recesses 25, the rotary latches 16 under the pressure of the rotary stop springs 17, snap back from their starting position into the open position. The door closing bolt is pressed by the walls of the chamferings 18 out of the lock box.

Figure 3:
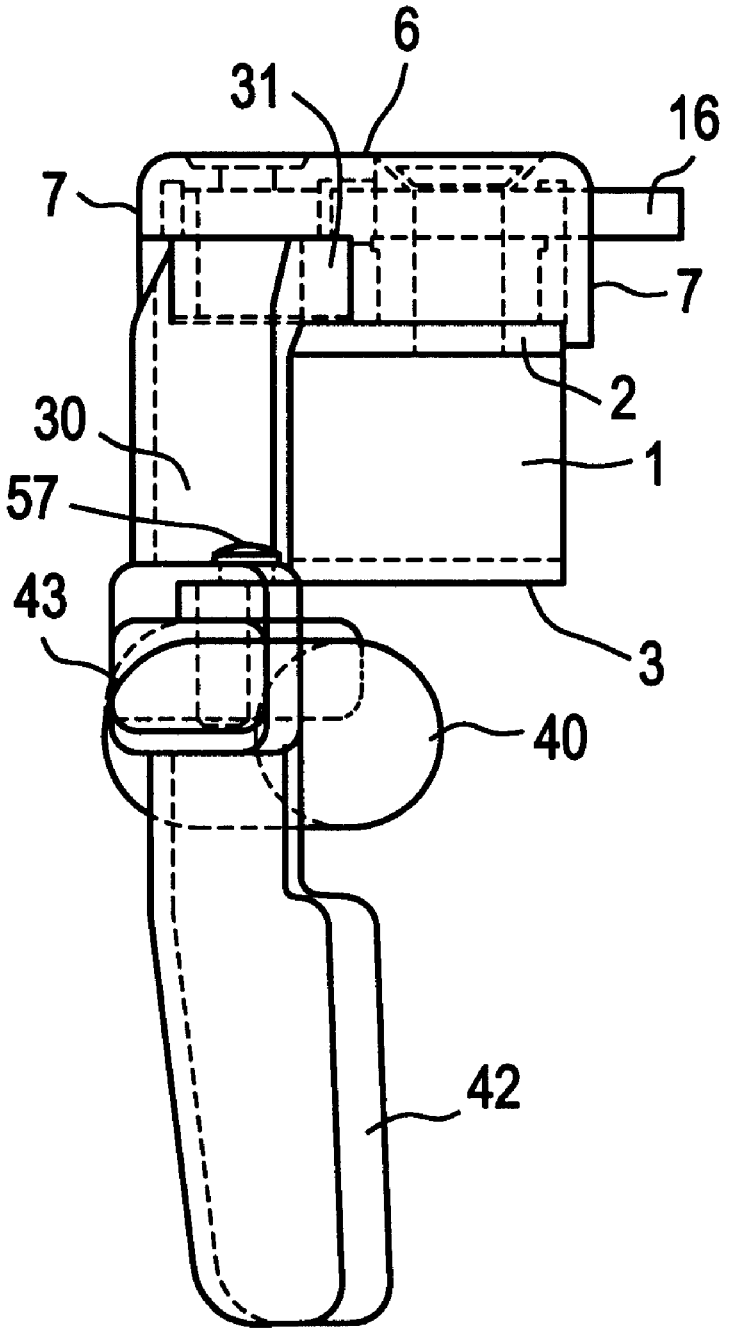
Figure 4:
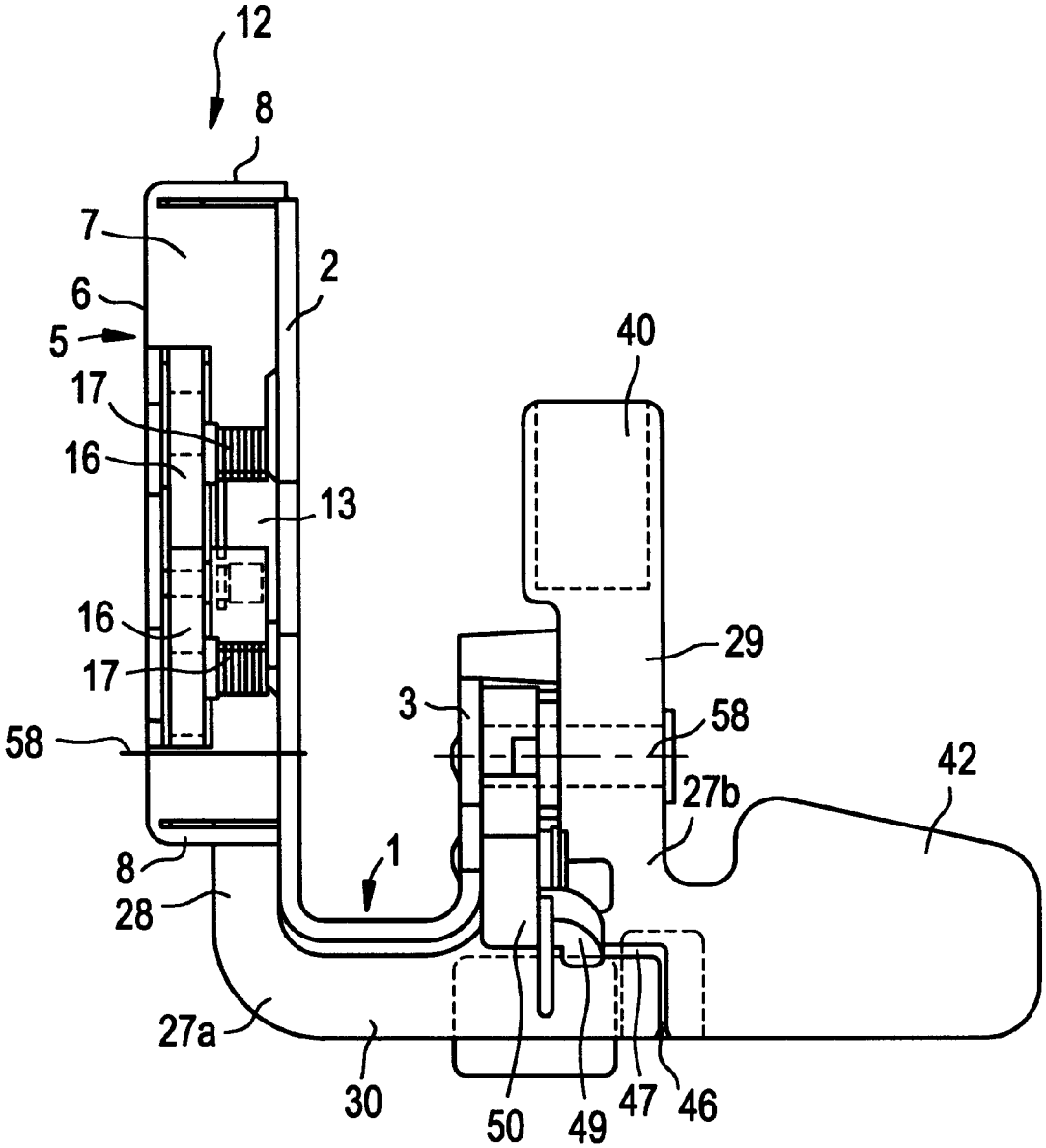
Figure 5:
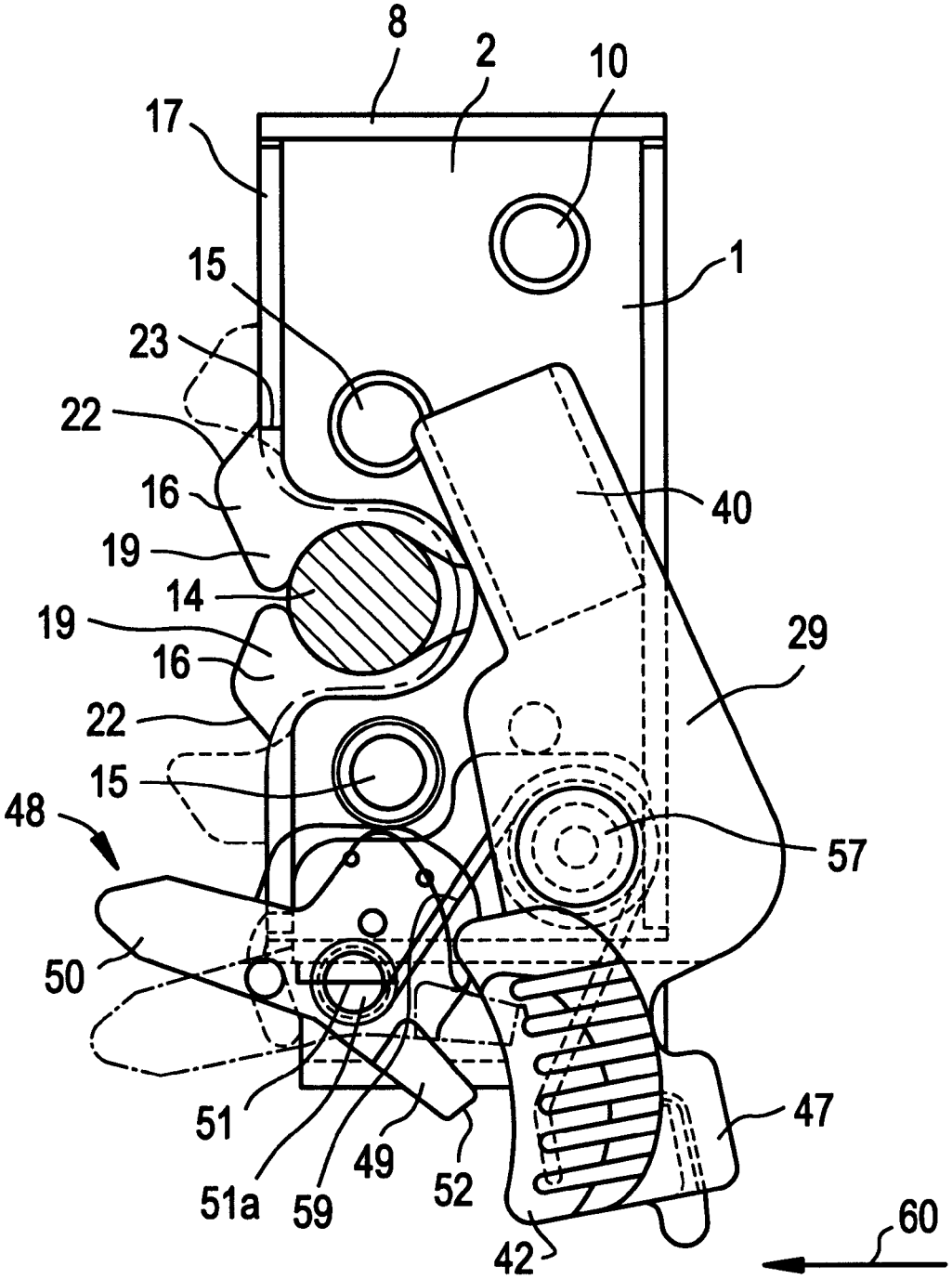
Figure 6:
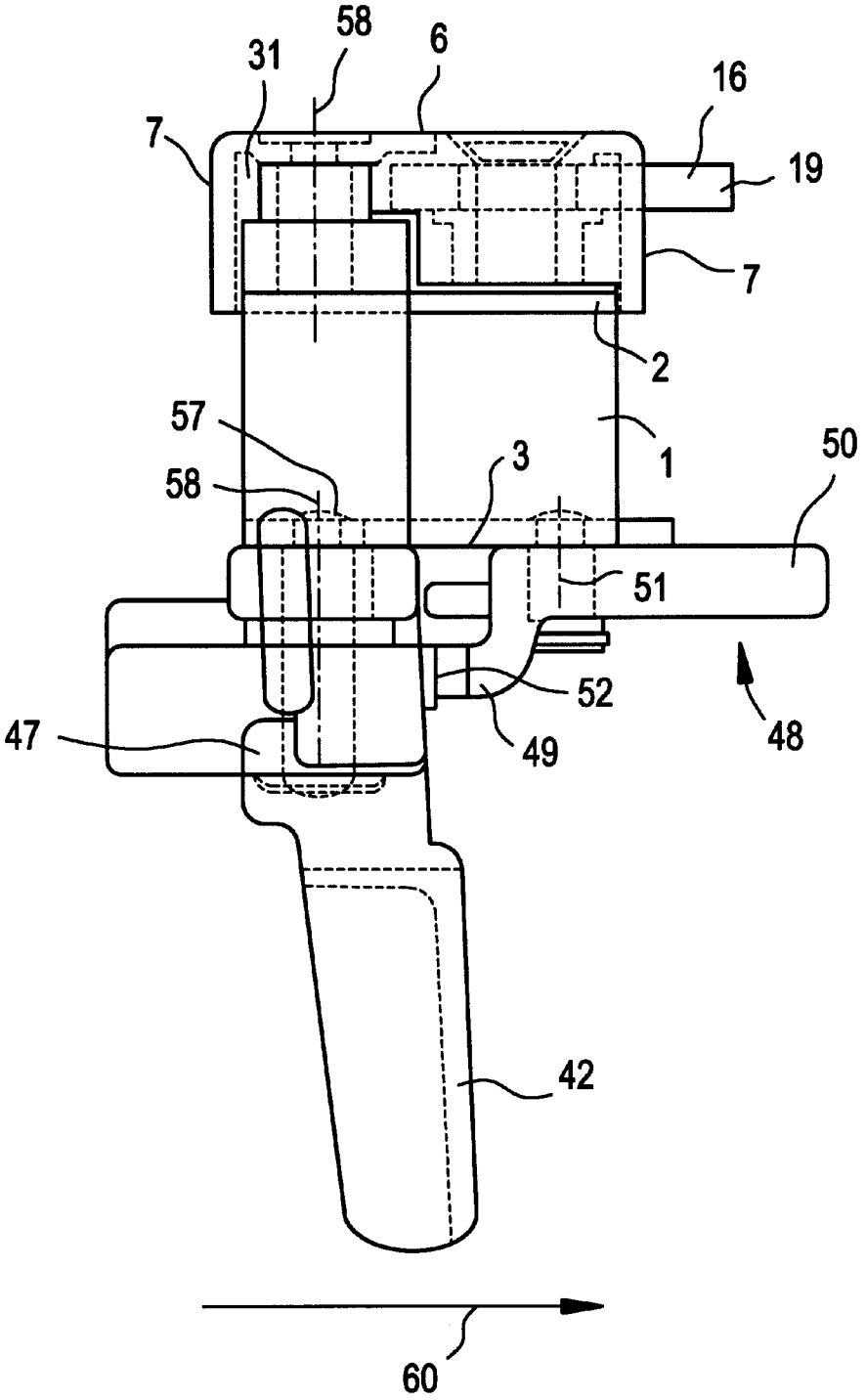

A further advantageous form of execution of the vehicle door lock of the invention is equipped with a child-protection safeguard, which makes it possible to prevent an opening of the lock from inside (FIGS. 3, 4, 6). For this purpose the unbolting lever 27 is subdivided into two parts 27*a*, 27*b*, in which the first part 27*a* has the U-shank 28 extending into the lock, as well as the U-base strip 30, and the second part 27*b* has the free U-shank 29 and the opening grip 42 acting on this. Between these two parts 27*a*, 27*b* of the unbolting lever 27 there is present in the zone of the branch-off from the U-base strip 30 to the U-shank 29 and to the actuating grip 42, a gap 46 by which the two parts executed in one piece are spatially separated.

On the actuating lever 42 there is present in operating or opening direction (arrow 60) in front of the U-base strip 30, a carry-along strip 47, that bridges the gap 46.

When the opening grip 42 is actuated in order to open the lock, the carry-along strip 47 acts on the U-base strip 30 and thus transfers the force acting on the opening grip 42 onto the U-base strip 30, the U-shank 28 and therewith also onto the stop piece 33.

In order to prevent an opening of the lock from the inside of the vehicle by actuating of the opening lever 42, on the free U-shank 3 of the lock base plate 1 there is arranged a swingable security lever 48. The security lever 48 is arranged, as seen in opening direction, behind the free U-shanks 29 of the unbolting lever 27, and it acts on this in a zone directly adjacent to the gap 46.

The security lever 48 has a safety arm 49 and an actuating arm 50 following upon it between which, perpendicularly to the common length extension of these two, there runs the pivot axis 51, about which the safety lever 48 is swingably arranged on the U-shank 3 by means of a pivot 51*a*. In the security position the security arm 49 acts with its face surface 52 on the U-shank 29 and blocks its movability.

Preferably the security lever 48 rests in the securing and in the unsecured end position, in order to prevent an undesired securing or non-securing.

In the case of a two-part releasing lever 27 a spring must act also on the U-shank 28 and therewith on the stop piece 33 in the direction of the stop position, since the spring 39 that acts on the U-shank, because of the constructive separation between U-shank 29 and U-base strip 30 no longer acts simultaneously on the U-shank 28.

Figure 9B:
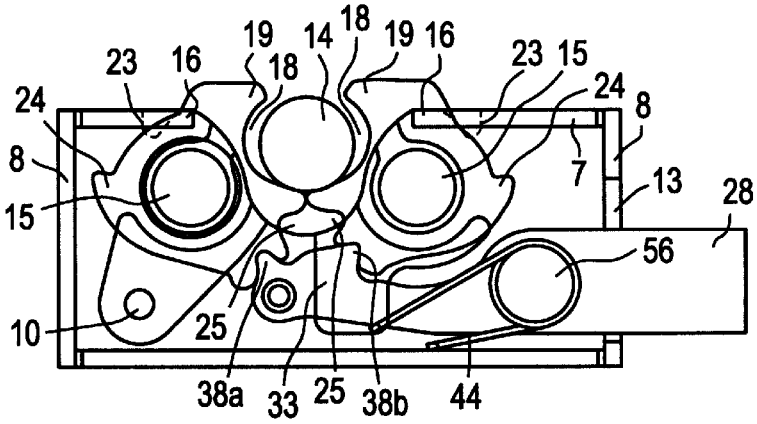
Figure 9C:
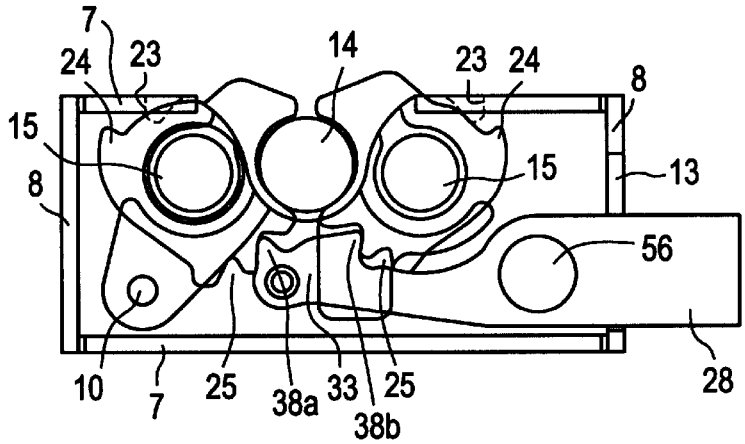

The spring 44 which acts on the stop piece can, as already stated, be arranged on the side of the U-shank 28 away from the rotary latches 16, between the shank 28 and the vertical side wall 7 of the lock box plate 5 in the form of a screw pressure spring 44 (FIGS. 8*a*, 8*b*, 8*c*) or, for example, also around the rotary pivot 57 of the shank 28, in which latter case a spring shank is supported on the vertical side wall 7 of the lock box plate 5, and the spring shank acting in opposite direction is supported on the side of the shank 28 away from the rotary latches 16 (FIG. 9*b*).

In a vehicle door lock according to the invention it is advantageous that the releasing lever is constructed in one piece. Hereby, for one thing, the manufacturing expenditure is considerably reduced, and in the second place, in the assembling there is avoided a complex lever system, with adjusting screws that must be adjusted in relation to one another, and that must be readjusted a certain number of times after use. A further advantage is that the lock box and the parts on which the lever system is articulated form, by means of the U-shaped lock base plate, a constructive unit and thus likewise do not have to be preassembled and afterwards further adjusted. The lock, accordingly, without having to be mounted on the usual carrier components, can be installed directly on or in the door.

Moreover, through the arrangement of the balancing weight on the lever side lying opposite the one on which it lies in the state of the art, it is prevented that this balancing weight, in case of jarring or impact, will open the lock by its persistent action; on the contrary the locking will even be secured.

Through the U-shaped execution of the lock base-plate and the arrangement of the releasing lever on this lock base plate, and not on the door plate, the lock can be pre-mounted, completely ready to function on a door plate or door frame, which considerably reduces the assembling expenditure.

Through the provision of a safeguard for children, finally, the safety of the vehicle door lock is substantially improved.

What is claimed is:

1. A rotary latch lock for a locking closure of a door comprising:

a rotary latch (16), a rotary latch spring (17) acting on the rotary latch (16), the lock also including a stop piece (33), the rotary latch (16) and the stop piece (33) being arranged in a lock box (12), the rotary latch (16) and the stop piece (33) being pivotally mounted and acting together for bolting the lock, and a lever system (27) for releasing the bolting of the lock, the lever system (27) including an actuating lever (29) and a stop lever (28) connected with the stop piece (33);

the rotary latch lock being provided with a lock base plate (1), the lock base plate (1) being bent in a U-shaped configuration to include first and second shanks (2, 3) and a base shank (4), the actuating lever (29) being articulated on the second shank (3), and the stop lever (28) being articulated on the first shank (2), the first shank (2) providing a wall of the lock box (12); and the lever system (27) being constructed in one piece.

2. A rotary latch lock for a locking closure of a door comprising:

a rotary latch (16), a rotary latch spring (17) acting on the rotary latch (16), the lock also including a stop piece (33), the rotary latch (16) and the stop piece (33) being arranged in a lock box (12), the rotary latch (16) and the stop piece (33) being pivotally mounted and acting together for bolting the lock, and a lever system (27) for releasing the bolting of the lock, the lever system (27) including an actuating lever (29) and a stop arm (28) connected with the stop piece (33);

the rotary latch lock being provided with a lock base plate (1), the lock base plate(l) being bent in a U-shaped configuration to include first and second shanks (2, 3) and a base shank (4), the actuating lever (29) being articulated on the second shank (3), and the stop arm (28) being articulated on the first shank (2), the first shank (2) providing a wall of the lock box (12); and a balancing weight (40) being mounted on the lever system (27) on which is arranged a free end of the actuating lever (29) lying opposite connecting means (30).

3. A rotary latch lock according to claim 2, wherein means are arranged on the lever system (27) so that the lever system (27) can be actuated both from an interior of a vehicle and also from outside of the vehicle.

4. A rotary latch lock according to claim 3, where the lever system (27) includes a divided construction so that on operation of the lever system (27) from the vehicle interior, the means of the lever system (27), which makes possible an operation of the lever system (27) from inside, is not co-activated.

5. A rotary latch lock according to claim 4, wherein a security lever (48) is arranged on the lock so that movability of the means, that actuate the lever system (27) from the inside, can be releasably blocked.

6. A rotary latch lock according to claims 5, wherein the security lever (48) is releasably engageable in a securing position and a non-securing position.

7. A rotary latch lock according to claim 6, wherein the stop piece (33) and the lever system (27) are constructed in one piece.

8. A rotary latch lock according to claim 5, wherein the security lever (48) is arranged in opening direction behind the actuating lever (29) of the releasing lever system (27) and acts thereon in a region directly adjacent to a gap (46).

9. A rotary latch lock according to claim 8, wherein the security lever (48) has a security arm (49), and an actuating arm (50) connecting thereto, between which, perpendicular to the common lengthwise extent, a pivot axis (51) is provided, about which the security lever (48) is pivotally mounted on the second shank (3) by means of a pivot **(51*a*)**.

10. A rotary latch lock according to claim 3, wherein the lever system (27) is subdivided into two levers **(27*a*, 27*b*), in which the stop arm (28) extending into the lock box (12) as well as a U-base strip (30) are constructed in one piece, and the actuating lever (29) and an opening lever (42) molded thereto are also constructed in one piece, a gap (46) being provided between these two levers (27*a*, 27*b*) of the releasing lever system (27) in the area of the branching-off from the U-base strip (30) to the actuating lever (29) and to the opening lever (42), by which gap (46) the two levers (27*a*, 27*b*)** are spatially separated.

11. A rotary latch lock according to claim 10, wherein a synchronizing strip (47) is arranged on the opening lever (42), the synchronizing strip (47) being located in actuating direction before the U-base strip (30) and bridging the gap (46), the synchronizing strip (47) transmitting a movement in opening direction of the opening lever (42) onto the U-base strip (30).

12. A rotary latch lock according to claim 10, wherein with the subdivided releasing lever system (27), a spring (44) acts on the stop arm (28) and therewith on the stop piece (33) in the direction of the stop position, in which the spring (44) that acts on the stop piece (33) is arranged on the side of the stop arm (28) between the stop arm (28) and a longitudinal side wall (7) of a lock box plate (5).

13. A rotary latch lock according to claim 12, wherein the spring (44) that acts on the stop piece (33) is a screw pressure spring.

14. A rotary latch lock according to claim 12, wherein the spring (44) acting on the stop arm (28) is arranged about a pivot pin (57) of the stop arm (28), a first spring shank is supported on the longitudinal side wall (7) of the lock box plate (5), and a second spring shank acting in opposite direction is supported on a side of the stop arm (28) away from rotary latches (16).

15. A rotary latch lock according to claim 10, wherein into a bore (43) there is turned an adjusting screw (45), an actuating element acts from outside of the door on the adjusting screw (45) acting on the lever system (27), so that by shifting of the adjusting screw (45), a free space can be adjusted between the actuating element and the lever system (27).

16. A rotary latch lock according to claim 15, wherein the adjusting screw (45), on the side of which the actuating element acts from outside of the door on the lever system (27), has a flat rounded head (60) with a smooth, rounded surface (61).

17. A rotary latch lock according to claim 16, wherein the actuating element rests without any free space on a surface (61) of the head (60) of the adjusting screw (45).

18. A rotary latch lock according to claim 16, wherein the adjusting screw (45) has a cross slot (63) on a side (62) lying opposite the head (60).

19. A rotary latch lock according to claim 18, wherein a spring (59) rests on the lever system (27), the spring (59) is elongated in the direction of crossing areas between the actuating lever (29), the U-base strip (30) and the opening lever (42) in the area of the adjusting screw (45) arranged on the lever system (27), and at a level of the bore (43) the spring (59) is bent over about 90 degrees and extends in the direction to the opening lever (42) beyond the bore (43), a spring shank of the spring (59) rests in one of two slots oriented at a right angle to one another providing the cross slot (63), and thus inhibits a turning of the screw (45).

20. A rotary latch lock for a locking closure of a door comprising:

a rotary latch (16), a rotary latch spring (17) acting on the rotary latch (16), the lock also including a stop piece (33), the rotary latch (16) and the stop piece (33) being arranged in a lock box (12), the rotary latch (16) and the stop piece (33) being pivotally mounted and acting together for bolting the lock, and a lever system (27) for releasing the bolting of the lock, the lever system (27) including an actuating lever (29) and a stop lever (28) connected with the stop piece (33);

the rotary latch lock being provided with a lock base plate (1), the lock base plate (1) being bent in a U-shaped configuration to include first and second shanks (2, 3) and a base shank (4), the actuating lever (29) being articulated on the second shank (3), and the stop lever (28) being articulated on the first shank (2), the first shank (2) providing a wall of the lock box (12); and the first and second shanks (2, 3) having different lengths and being vertically oriented, and the base shank (4) being horizontally oriented.

21. A rotary latch lock according to claim 20, where a lock box plate (5) is mounted onto an outer flat side of the first shank (2).

22. A rotary latch lock according to claim 21, wherein the lock box plate (5) has a rectangular base wall (6) which is oriented vertically with respect to its lengthwise extent, and the width of which corresponds to the width of the first shank (2), and the spatial orientation of the first shank (2) in which, onto the long sides of the base wall (6) there are joined two longitudinal side walls (7) and onto the narrow sides of the base wall (6) there are joined two face side walls (8).

23. A rotary latch lock according to claim 22, wherein the longitudinal side walls (7) and an upper face side wall (8) rest on edges (9) of the first shank (2), and a lower face side wall (8) rests with its face surface on the first shank (2), so that the first shank (2) and the lock box plate (5) provide the lock box (12) on the outside of the first shank (2) of the lock base plate (1), the lock box (12) being flat slab-shaped.

24. A rotary latch lock according to claim 23, wherein in the lock box (12), about in the longitudinal middle of a longitudinal side wall (7), there is arranged an approximately semicircular or elliptical recess (13) which creates space for the reception of a door closing bolt (14).

25. A rotary latch lock according to claim 24, wherein the recess (13) extends from a longitudinal side wall (7) to nearly the transverse middle of the lock base plate (1) and the transverse middle of the lock box plate (5).

26. A rotary latch lock according to claim 24, wherein on an upper side and an under side of the recess (13), about in the middle of the horizontal extent of the recess (13) in each case, hollow cylindrical axial bolts (15) are arranged between the lock base plate (1) and the lock box plate (5), which pierce the lock base plate (1) and the lock box plate (5), and fasten them together.

27. A rotary latch lock according to claim 26, wherein in the hollow cylindrical axial bolts (15), there are arranged screws with which the lock is screwed to a door or a door frame.

28. A rotary latch lock according to claim 26, wherein on each of at least one horizontal axial bolt (15) adjacent to the base wall (6) of the lock box plate (5), there is pivotally mounted at least one rotary latch (16).

29. A rotary latch lock according to claim 26, wherein on each of the horizontal axial bolts (15) adjacent to the base wall (6) of the lock box plate (5), there is arranged a rotary latch (16) having a common plane and arranged spaced from one another.

30. A rotary latch lock according to claim 29, wherein between each rotary latch (16) and each lock base plate (1), there is arranged a rotary latch spring (17).

31. A rotary latch lock according to claim 30, wherein the rotary latch springs (17) are arranged so that a first spring shank thereof acts on a projection (24) molded to each of the rotary latches (16), the projections (24) lying about diametrically to the chamferings (18) on the rotary latches (16), and a second spring shank of the rotary latch springs (17) supporting one of the longitudinal side walls (7).

32. A rotary latch lock according to claim 31, wherein the rotary latch springs (17) are connected with the second spring shank.

33. A rotary latch lock according to claim 29, where the rotary latches (16) are tooth shaped elements, fabricated of steel.

34. A rotary latch lock according to claim 29, wherein on each rotary latch (16), there are arranged a bolting lug (19) with a chamfering (18), in which arrangement in open lock position the lugs (19) project laterally beyond the longitudinal side wall (7) in which the recess (13) is arranged, and the chamferings (18) of the bolting lugs (19) of the rotary latches (16) are arranged.

35. A rotary latch lock according to claim 34, wherein on surrounding walls of the rotary latches (16), lying opposite the chamferings (18), stop surfaces (22) are arranged which bear on the edges (23) bounding the recess (13) of the side wall (7) in open position of the lock.

36. A rotary latch lock according to claim 34, wherein the rotary latch springs (17) are arranged in the lock so that the spring tension has the tendency to hold the rotary latches (16) in open position to push apart the bolting lugs (19) facing one another.

37. A rotary latch lock for a locking closure of a door comprising:

a rotary latch (16), a rotary latch spring (17) acting on the rotary latch (16), the lock also including a stop piece (33), the rotary latch (15) and the stop piece (33) being arranged in a lock box (12), the rotary latch (16) and the stop piece (33) being pivotally mounted and acting together for bolting the lock, and a lever system (27) for releasing the bolting of the lock, the lever system (27) including an actuating lever (29) and a stop arm (28) connected with the stop piece (33);

the rotary latch lock being provided with a lock base plate (1), the lock base plate (1) being bent in a U-shaped configuration to include first and second shanks (2, 3) and a base shank (4), the actuating lever (29) being articulated on the second shank (3), and the stop arm (28) being articulated on the first shank (2), the first shank (2) providing a wall of the lock box (12); and the lever system including a substantially U-shaped unbolting lever arranged at and around the U-shaped lock base plate (1), the unbolting lever having two free U-shanks (28, 29) defining the stop arm (28) and actuating lever (29), the unbolting lever also having a U-base strip as a connecting element (30).

38. A rotary latch lock according to claim 37, wherein the connecting element (30) is arranged substantially parallel to the base strip (4) of the lock base plate (1), in which arrangement, substantially parallel to the first shank (2) of the lock base plate (1), the stop arm (28) of the lever (27) extends in the direction of the lock box (12), and it extends through a recess (31) in a face side wall (8) facing the base shank (4), into the lock box (12).

39. A rotary latch lock according to claim 37, wherein an opening grip (42) provides means for actuating the lever system or for actuating the actuating lever (29), the opening grip (42) being molded onto the actuating lever (29) in extension of the U-base strip (30) or of the connecting means (30) beyond the actuating lever (29).

40. A rotary latch lock according to claim 39, wherein a crossing zone between the shank (29), the U-base strip (30) or the connecting piece (30) and the opening grip (42) has a bore (43) perpendicular to the extension direction of the shank (29) and of the opening grip (42), the bore (43) serving for the reception of an actuating element with which the lever system or the actuating lever (29) can be actuated from outside of the door.

41. A rotary latch lock according to claim 37, wherein a free end of the stop arm (28) extends up to an area of the space between two rotary latches (16), where in the direction to the rotary latches (16) and perpendicular to the extension direction of the lever (27), an approximately rectangular stop piece (33) is molded on the lever (27), the stop piece (33) having two face edges (34, 35) and a longitudinal edge (36) which connects the face edges (34, 35) and provides therewith common corners (37*a,* 37*b*).

42. A rotary latch lock according to claim 41, wherein between the vertical side wall (77) facing away from the stop piece (33) and the free end of the U-shank (28), there is arranged a spring (44) which presses the stop piece into the rest recesses (25) against the rotary latches (16) and, with open lock, onto the rest recesses (25).

43. A rotary latch lock according to claim 41, wherein a chamfer (39) is provided in the longitudinal edge (36) which is shifted in the direction of the free end of the shank (28), so that edge pieces (36*a,* 36*b*) are provided which have different lengths from the bottom of the chamfer (39) to the corners (37), where in each case a lock lug (38*a,* 38*b*) is provided.

44. A rotary latch lock according to claim 43, wherein the corners (37*a,* 37*b*) are rounded, the edges (35, 36*b*) providing in each case an acute angle.

45. A rotary latch lock according to claim 43, wherein the edge (35) from the corner (37*b*) to the shank (28) is slightly undercut, so that the rest piece (33) to the corners (37*a,* 37*b*) is somewhat wider in the region of the edge (35).

46. A rotary latch lock according to claim 43, wherein the edge (36*b*) from the bottom of the chamfer (39) to the corner (37*b*) is slightly curved outward so that from the bottom of the chamfer (39) it has a steeper course and becomes flatter toward the corner (37*b*).

47. A rotary latch lock according to claim 41, wherein between rest piece (33) and the horizontal wall (8) facing the U-base strips (4, 30) of the lock box (12), the shank (28) of the lever (27) is swingably borne on a hollow cylindrical horizontal pivot (56) penetrating and connecting the lock base plate (1) and the lock box plate (5).

48. A rotary latch lock according to claim 47, wherein on the outside of the U-shank (3) of the lock base plate (1), there is arranged a second rotary pivot (57) coaxial to a first pivot (56), and on which the lever (27) with its actuating lever (29) is likewise pivotally mounted, the rotary pivots (36, 37) having the same pivot axis (38).

49. A rotary latch lock according to claim 48, wherein a spring (59) is arranged around the rotary pivot (57) which acts on the lever (27) so that the rest piece (33) is pressed against the rotary latch (16), or the rotary latches (16), and contacts at least one of the rotarty latches (16).

* * * * *